US007600969B2

(12) United States Patent
Frankenstein et al.

(10) Patent No.: US 7,600,969 B2
(45) Date of Patent: Oct. 13, 2009

(54) TURBOCHARGER

(75) Inventors: Dirk Frankenstein, Worms (DE); Ralf Boening, Reiffelbach (DE); Hartmut Weiss, Netphen (DE)

(73) Assignee: BorgWarner Inc., Auburn Hills, MI (US)

( * ) Notice: Subject to any disclaimer, the term of this patent is extended or adjusted under 35 U.S.C. 154(b) by 474 days.

(21) Appl. No.: 11/300,066

(22) Filed: Dec. 14, 2005

(65) Prior Publication Data

US 2006/0127244 A1 Jun. 15, 2006

(30) Foreign Application Priority Data

Dec. 14, 2004 (DE) ..... 040 29 586

(51) Int. Cl.
*F01D 25/00* (2006.01)

(52) U.S. Cl. ..... 415/177; 417/373; 417/407; 267/151

(58) Field of Classification Search ..... 415/177; 417/373, 407, 423.8; 267/151, 158, 160
See application file for complete search history.

(56) References Cited

U.S. PATENT DOCUMENTS

| | | | | |
|---|---|---|---|---|
| 3,106,381 | A * | 10/1963 | Leins | 415/119 |
| 3,945,762 | A * | 3/1976 | Leicht | 417/18 |
| 4,702,672 | A * | 10/1987 | Leicht et al. | 415/164 |
| 5,087,176 | A * | 2/1992 | Wieland | 417/407 |
| 5,121,605 | A * | 6/1992 | Oda et al. | 60/608 |
| 6,739,845 | B2 * | 5/2004 | Woollenweber | 417/407 |
| 7,025,579 | B2 * | 4/2006 | Woollenweber et al. | 417/407 |
| 2002/0041813 | A1 * | 4/2002 | Fledersbacher et al. | 417/407 |
| 2003/0223892 | A1 * | 12/2003 | Woollenweber | 417/407 |
| 2006/0037317 | A1 * | 2/2006 | Leavesley | 60/602 |

FOREIGN PATENT DOCUMENTS

| | | | |
|---|---|---|---|
| DE | 30 23 009 | A1 | 1/1982 |
| DE | 232 524 | A1 | 1/1986 |
| EP | 0 160 460 | B1 | 7/1991 |
| EP | 1 398 463 | A1 | 3/2004 |
| GB | 2246183 | A * | 1/1992 |
| JP | 57013234 | A | 1/1982 |
| WO | WO 2004/027218 | A1 | 4/2004 |
| WO | WO 2004/048755 | A1 | 6/2004 |
| WO | WO 2004048755 | A1 * | 6/2004 |

OTHER PUBLICATIONS http://www.wikipedia.org/ [online] [http://en.wikipedia.org/wiki/Woodruff_key] [retrieved on Jun. 26, 2008].*

* cited by examiner

*Primary Examiner*—Edward Look
*Assistant Examiner*—Aaron R Eastman
(74) *Attorney, Agent, or Firm*—Warn Partners, P.C.

(57) ABSTRACT

A turbocharger comprising a cartridge which is arranged in a turbine casing for variable turbine geometry; a bearing housing which is arranged between the turbine casing and a compressor housing of a compressor impeller and in which a bearing assembly is arranged for a shaft which supports the turbine wheel and the compressor impeller; and a spring washer which is arranged between the cartridge and the bearing housing, the spring washer being composed of at least two material layers.

16 Claims, 3 Drawing Sheets

TURBOCHARGER

CROSS-REFERENCE TO RELATED APPLICATIONS

This application claims priority to European Patent Application No. 04029586.7 filed Dec. 14, 2004.

FIELD OF THE INVENTION

The present invention relates to a turbocharger. Such a turbocharger is known from WO 2004/048 755 A.

BACKGROUND OF THE INVENTION

A further turbocharger is known from EP 1 398 463 A1. A heat shield is provided in said turbocharger around the shaft thereof at the turbine side, the heat shield serving to protect the bearing housing against damage caused by elevated temperatures due to the exhaust gases of the combustion engine that are flowing through the turbine. The known heat shield consists of a single-layer component, the thermal insulation properties of which are however in need of improvement.

EP 0 160 460 B1 discloses a further assembly which uses a woodruff key that exerts an axial biasing force on the vane bearing ring to be fixed axially. The function of the thermal insulation is not required at said place due to remoteness from the turbine wheel.

It is therefore the object of the present invention to provide a turbocharger which ensures an axial fixation of the cartridge of variable turbine geometry near the turbine wheel by means of a spring washer on the one hand and permits an improved thermal insulation towards the bearing housing by means of the heat shield on the other hand.

SUMMARY OF THE INVENTION

The spring washer of the turbocharger of the invention is formed by at least two, but optionally also more than two, material layers and has the function of generating the biasing force and of improving the shielding function by increasing thermal resistance. It is thereby possible to ensure the function, especially also at elevated exhaust gas temperatures.

In addition, a liquid type cooling for the bearing housing can advantageously be omitted, if desired.

Thanks to the provision of several material layers it is possible to provide an air gap between the material layers for further improving the biasing force and/or thermal insulation properties.

To this end it is preferably possible to configure one of the material layers in a pot-like configuration with a surrounding raised edge, whereas the other material layer is preferably configured as a flat disk.

The material layers may form an integral part or also two separate parts which in the mounted state rest on one another.

Furthermore, it is in principle possible that the material layers consist of the same material or that different materials are chosen.

Further details, advantages and features of the present invention become apparent from the following description of the invention with reference to the attached drawing, in which:

DETAILED DESCRIPTION OF THE PREFERRED EMBODIMENTS

Figure 1:
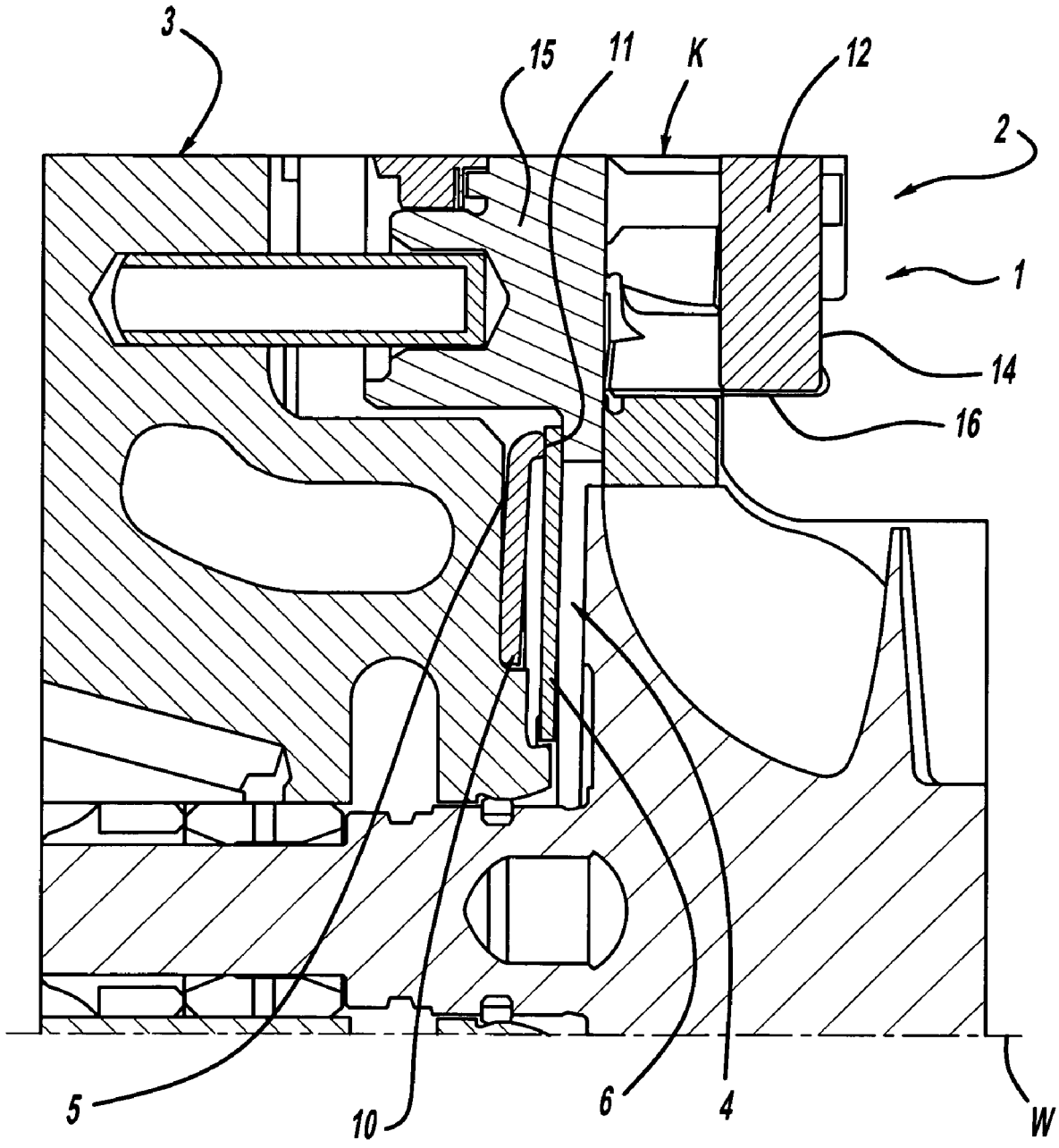
FIG. 1 shows part of a turbocharger of the invention with a spring washer of the invention.

FIG. 1 shows a portion of a turbocharger 1 according to the invention because this illustration is adequate for explaining the principles according to the invention. Of course, the turbocharger 1 comprises all constructional elements that are normally provided, but, as has been stated, have been omitted in FIG. 1 for simplifying the illustration.

Hence, FIG. 1 shows a turbine casing 2 of a turbine that is arranged next to a bearing housing 3. Said bearing housing 3 is arranged between the turbine casing 2 and a compressor casing (not shown) of a compressor impeller, which is also not plotted. The bearing housing 3 comprises the bearing for a shaft which is symbolized in FIG. 1 by the dash-dotted center line W because FIG. 1 only shows the upper portion of the turbocharger 1 according to the invention.

Shaft W carries the turbine and the compressor impeller and is supported via an appropriate bearing assembly in bearing housing 3.

An inventive spring washer 4 which is made of several layers is clamped between the bearing housing 3 and a cartridge K which is formed by a variable turbine geometry disk 12 with axial stop 14 and a vane bearing ring 15 and which is axially displaceably arranged in the turbine casing 2. In the example, two material layers 5 and 6 are here provided. These will be explained in more detail with reference to FIGS. 2 and 3 hereinafter.

FIG. 1 illustrates the arrangement of the spring washer 4 between the turbine casing 2 and the bearing housing 3. Due to the stepped configuration of the spring washer 4 two support portions 10, 11 are obtained with which the spring washer, as can be seen in detail in FIG. 1, is supported on the corresponding parts of the turbine casing 2 and the cartridge of variable turbine geometry and of the bearing housing 3, respectively.

Figure 2:
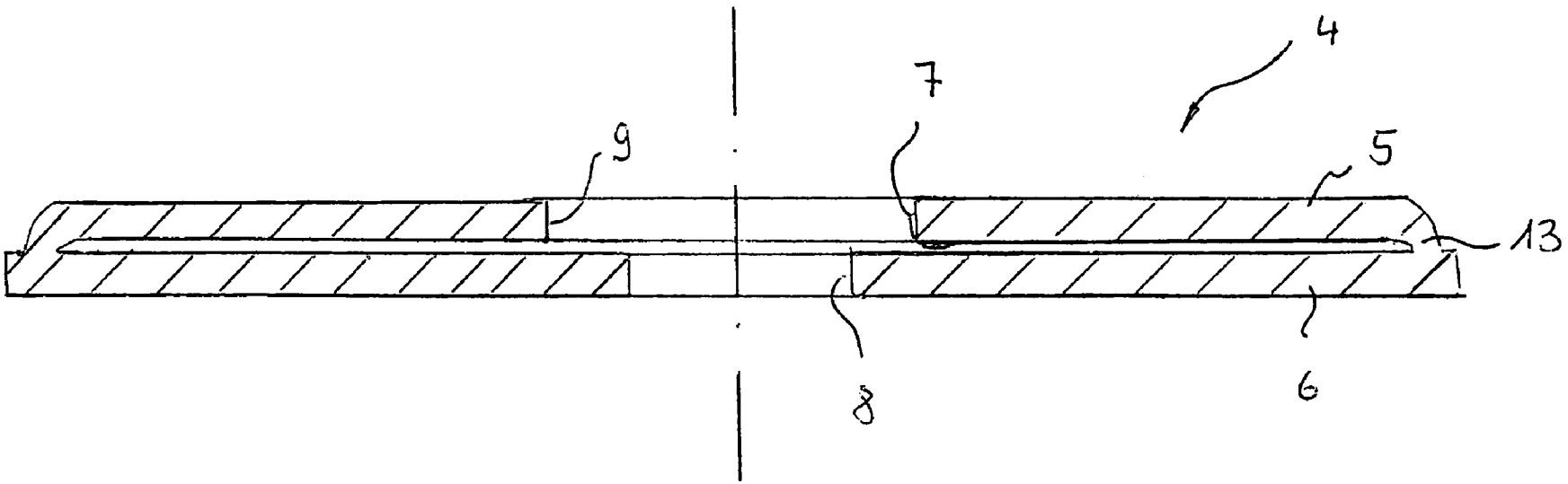
FIG. 2 is a sectional view showing a first embodiment of the spring washer of the invention.

FIG. 2 shows a first embodiment of the spring washer 4 of the invention. The two material layers 5 and 6 are interconnected as one part in this embodiment, resulting in a uniform part. FIG. 2 illustrates that the material layer 5 which applies the axial biasing force has a pot-like configuration with a surrounding raised edge 13. Furthermore, the material layer 5 comprises a central recess 9 which is arranged coaxial to a central recess 8 of the material layer 6, which serves as a heat shield for the material layer 5, but has a diameter of an identical size or of an increased size. An air gap 7 which further improves the thermal insulation characteristics is provided between the material layers 5 and 6.

Figure 3:
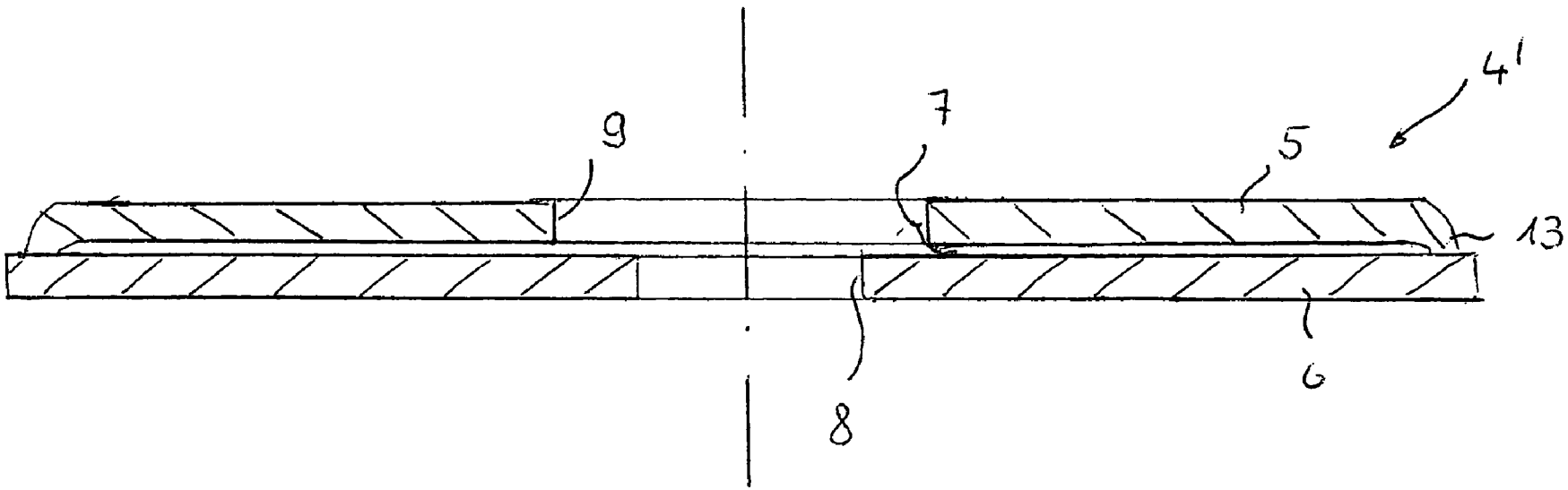
FIG. 3 is a view corresponding to FIG. 2, which shows a second embodiment of the spring washer according to the invention.

FIG. 3 shows an alternative embodiment of the spring washer which is designated in this figure with reference numeral 4' in its entirety. All of the other corresponding parts are provided with the same reference numerals as in FIG. 2.

In contrast to the embodiment shown in FIG. 2, the material layers 5 and 6 are here separated members which are shown in FIG. 3 in the mounted state, i.e., in a position superimposed one upon the other. Apart from this, reference can be made to the description regarding FIG. 2.

As becomes apparent from the joint study of FIGS. 2 and 3, the material layer 6 is a flat disk in both cases.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A turbocharger comprising:

a turbine casing of a turbine wheel;

a cartridge arranged in the turbine casing for variable turbine geometry;

a bearing housing which is arranged between the turbine casing and a compressor housing of a compressor impeller and in which a bearing assembly is arranged for a shaft which supports the turbine wheel and the compressor impeller; and a spring washer which is operably located between the cartridge and the bearing housing and which comprises at least two material layers, said at least two material layers having first material layer configured with a surrounding raised edge and formed to apply an axial biasing force, and a second material layer configured as a flat disk and formed as a thermal protection layer for said first material layer, wherein said surrounding raised edge of said first material layer rests on said second material layer in a mounted state.

2. The turbocharger according to claim 1, wherein an air gap is arranged between the at least two material layers.

3. The turbocharger according to claim 1, wherein the first material layer has a pot-like configuration with the surrounding raised edge.

4. The turbocharger according to claim 1, wherein the spring washer is operable to provide a biasing force that provides axial fixation of the cartridge axially in the turbine casing.

5. The turbocharger according to claim 1, wherein the at least two material layers are integrally connected to each other.

6. The turbocharger according to claim 1, wherein the at least two material layers are separate members superimposed upon each other in the mounted state.

7. The turbocharger according to claim 1, wherein the at least two material layers consist of the same material.

8. The turbocharger according to claim 1, wherein the at least two material layers consist of different materials.

9. A turbocharger comprising:

a turbine casing of a turbine wheel;

a cartridge axially arranged with a variable turbine geometry disk and a vane bearing ring in the turbine casing for variable turbine geometry;

a bearing housing which is arranged between the turbine casing and a compressor housing of a compressor impeller and in which a bearing assembly is arranged for a shaft which supports the turbine wheel and the compressor impeller; and a spring washer which is located between the turbine casing and the bearing housing and which comprises at least two material layers, said at least two material layers comprising first material layer configured with a surrounding raised edge and formed to apply an axial spring washer force, and a second material layer configured as a disk and formed as a thermal protection layer for said first material layer;

wherein said first material layer rests on said second material layer in a mounted state with its surrounding raised edge.

10. The turbocharger according to claim 9, wherein an air gap is arranged between the at least two material layers.

11. The turbocharger according to claim 9, wherein the first material layer has a pot-like configuration with the surrounding raised edge.

12. The turbocharger according to claim 9, wherein the spring washer is operable to provide a biasing force that provides axial fixation of the cartridge axially in the turbine casing.

13. The turbocharger according to claim 9, wherein the at least two material layers are integrally connected to each other.

14. The turbocharger according to claim 9, wherein the at least two material layers are separate members superimposed upon each other in the mounted state.

15. The turbocharger according to claim 9, wherein the at least two material layers consist of the same material.

16. The turbocharger according to claim 9, wherein the at least two material layers consist of different materials.

* * * * *